United States Patent [19]

Poe

[11] Patent Number: 4,902,051

[45] Date of Patent: Feb. 20, 1990

[54] ROD END LOCK

[75] Inventor: L. Richard Poe, Long Beach, Calif.

[73] Assignee: The Hartwell Corporation, Placentia, Calif.

[21] Appl. No.: 92,049

[22] Filed: Sep. 2, 1987

[51] Int. Cl.[4] ..... E05C 19/10

[52] U.S. Cl. ..... 292/127; 292/227

[58] Field of Search ..... 292/127, 227, 302, 96, 292/DIG. 55, DIG. 53, 341.17, 221, DIG. 14

[56] References Cited

U.S. PATENT DOCUMENTS

| | | | |
|---|---|---|---|
| 643,612 | 2/1900 | Thuestad | 292/127 |
| 1,778,474 | 10/1930 | Wiley | 292/DIG. 14 X |
| 1,954,500 | 4/1934 | Sparks | 292/127 |
| 4,073,520 | 2/1978 | Tsuchiya et al. | 292/DIG. 55 X |
| 4,129,325 | 12/1978 | Hern et al. | 292/127 |
| 4,174,128 | 11/1979 | Styck | 292/127 |
| 4,208,837 | 6/1980 | Black, Sr. et al. | 292/229 X |
| 4,466,643 | 8/1984 | Godec et al. | 292/210 X |
| 4,478,441 | 10/1984 | Fiordellisi et al. | 292/216 |

FOREIGN PATENT DOCUMENTS

| | | | |
|---|---|---|---|
| 563116 | 12/1957 | Belgium | 292/302 |
| 1130891 | 2/1957 | France | 292/DIG. 72 |
| 1236564 | 6/1971 | United Kingdom | 292/127 |

*Primary Examiner*—Gary L. Smith
*Assistant Examiner*—Michael Milano
*Attorney, Agent, or Firm*—Lyon & Lyon

[57] ABSTRACT

A rod end lock for latching heavy objects. The rod end lock has a barrel with a mounting end and a latch end. The latch end has a bite portion such that a keeper is secured at a location centered about the axis of the barrel. The mounting end is coaxial with the barrel and has the same centerline. A locking element is movably connected to the barrel and is biased in a closed position such that the locking element and the bite portion form an enclosed space therebetween for latching the keeper. The keeper is released by actuating the locking element to the open position thereby overcoming the bias to the closed position.

9 Claims, 4 Drawing Sheets

ROD END LOCK

BACKGROUND OF THE INVENTION

There are many devices available for latching heavy objects such as aircraft doors to their opened and closed positions. Unlike latch devices which catch lightweight objects, the design of rod end locks require balancing the bending moment between its mounting position and its latch point. In fact, the desired design should induce no such bending moment from its latch point to its mounting connection.

Existing rod end locks minimize the bending moment by offsetting the mounting position from the centerline of a locked barrel to compensate for the end moment applied by the latch end. Such a design creates manufacturing inefficiences since machining of offset components is more difficult than machining concentric components. A rod end lock having offset components with the accompanying bending moments also creates greater stresses at various component interfaces.

SUMMARY OF THE INVENTION

The present invention is directed to a rod end lock for latching heavy objects. To this end, the rod end lock has a barrel with a mounting end and a latch end. The latch end has a bite portion such that the rod is secured at a location centered about the centerline of the barrel. The mounting end has a mount connection which is also concentric with the centerline of the barrel. Since both the rod in its secured position and the mount connection are centered about the centerline of the barrel, the rod end lock introduces no bending moment between its mounting end and its latch end.

DETAILED DESCRIPTION OF THE PREFERRED EMBODIMENTS

Figure 7:
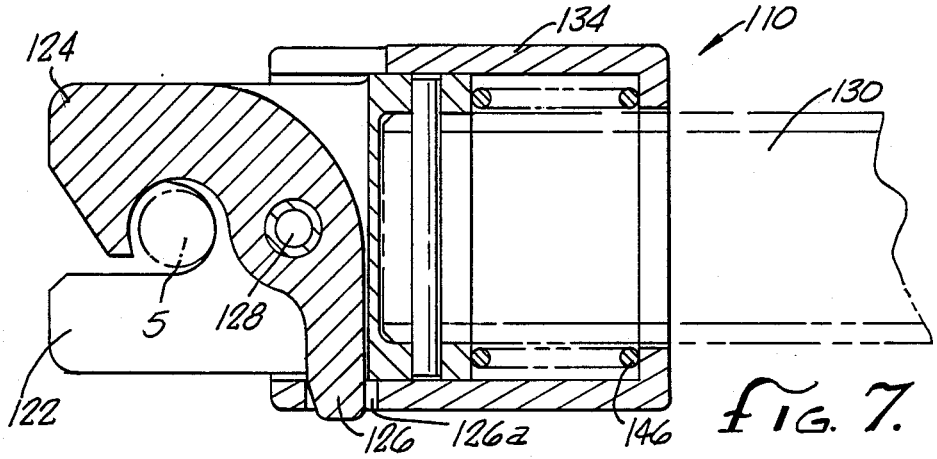
FIG. 7 illustrates the embodiment of FIG. 6 in the closed position.
Figure 8:
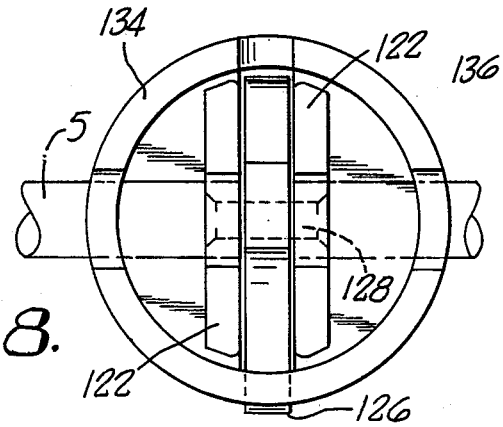
FIG. 8 is a front view of the embodiment of FIG. 6 in the closed position.

The present invention will be described with reference to the drawings. For convenience any numeral used to identify an element on one figure will represent the same or equivalent element on any other figure. Further, similar elements on the different embodiments are identified by a similar numeral. For example, in the first embodiment, FIG. 3 has spring 46; the second embodiment FIG. 7 has spring 146; and the third embodiment FIG. 13 has spring 246.

Figure 1:
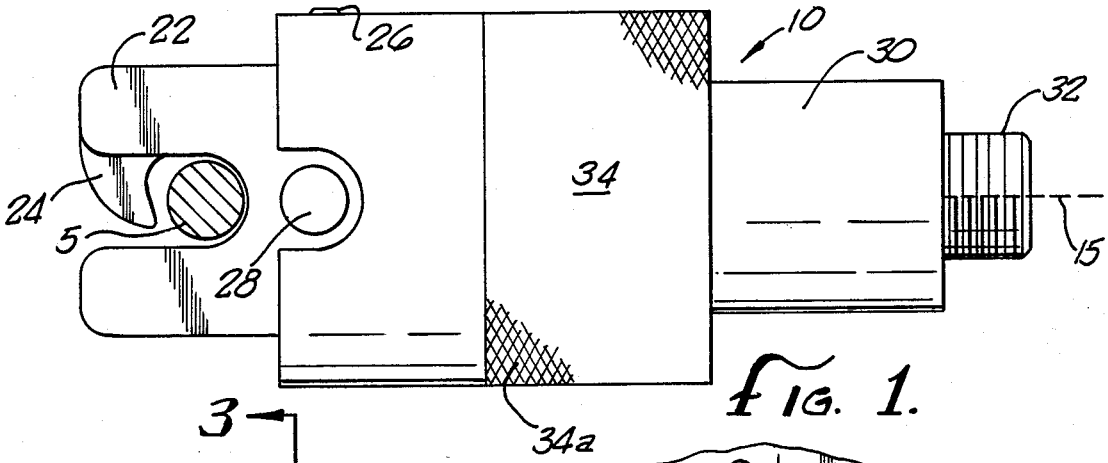
FIG. 1 illustrates a side view of a rod end lock according to the present invention in the closed position.

FIGS. 1–5 illustrate a front entry rod end lock according to the present invention. FIG. 1 illustrates a side view of the rod end lock 10. The rod end lock 10 has a main tube or barrel 30. On one end of the barrel 30 is the mounting means shown as a threaded mount 32 centered on the end of the barrel 30. On the opposite end is the locking or bite portion 22 into which a keeper rod 5 may be inserted. The locking element is a hook 24 which is pivotally mounted on a pivot shaft 28. In combination with the U-shaped bite portions 22, the locking element 24 encloses the keeper rod 5. A sleeve 34 is a cylindrically shaped collar about the barrel 30 and the end locking or bite portion 22. The sleeve 34 has a knurled portion **34*a*** which may be manually grasped for actuation.

Figure 2:
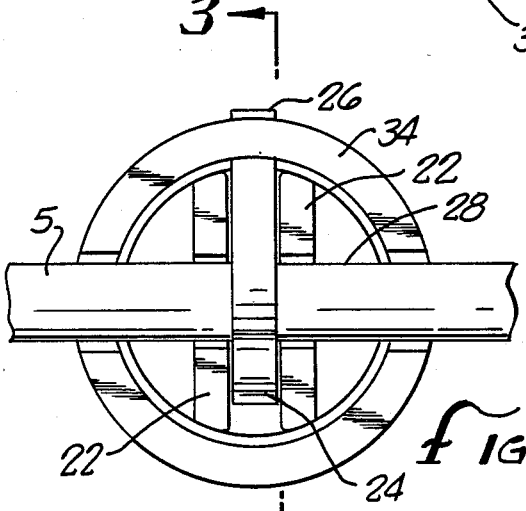
FIG. 2 illustrates a front view of the latch end of the present invention in the closed position.
Figure 3:
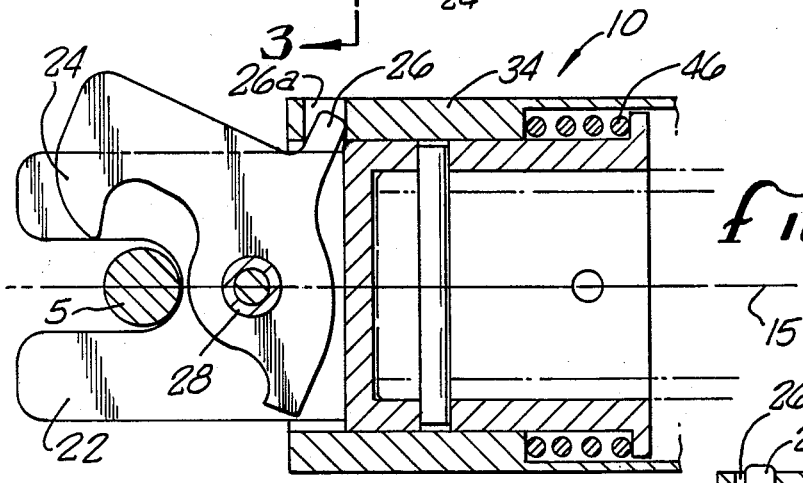
FIG. 3 is a cross-sectional view of FIG. 2 taken along the lines 3—3 showing the lock in the open position.
Figure 4:
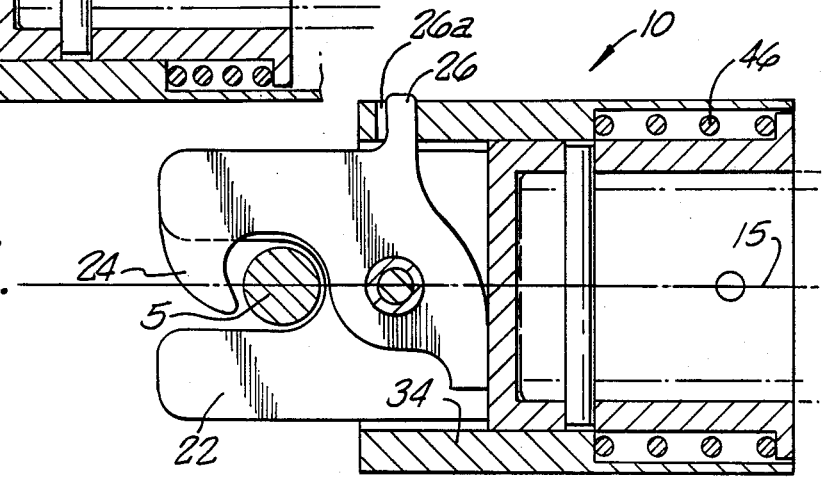
FIG. 4 is a cross-sectional view similar to FIG. 3 showing the lock in the closed postion.
Figure 6:
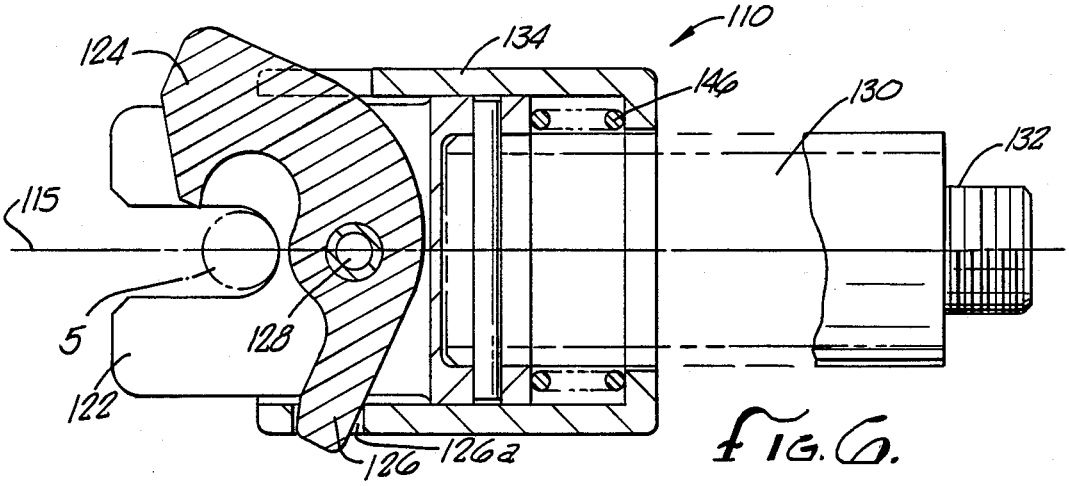
FIG. 6 illustrates a cross-sectional view of an alternate embodiment to FIGS. 1–5 showing the latch end of the present invention in the open position.

As further illustrated in FIGS. 2–4, the hook 24 pivots about the pivot shaft 28 to allow insertion of the keeper rod 5 into the U-shaped bite portions 22. The hook 24 has an extended portion 26 which is positioned within a slot **26*a* of the sleeve 34. The sleeve 34 is urged by a spring 46 against the extended portion 26 of the hook 24 thereby urging the hook 24 into the closed position as shown in FIG. 4. The keeper rod 5 may be released by pulling back on the sleeve 34 thereby pivoting the hook 24 clockwise as in FIG. 3**.

The keeper rod 5 may be inserted into the bite portion 22 by pressing the hook 24 against the keeper rod 5. The hook 24 has a curved outer surface (as shown by the tip **24*a* in FIG. 5) which allows the keeper rod 5 to urge a pivoting action of the hook 24 and compress the spring 46. Once the keeper rod 5 passes the tip of the hook 24, the hook 24 is urged back into the closed position by the spring 46 as shown in FIG. 4. This preferred embodiment as shown in FIG. 3 shows actuation of the hook 24 by a motion of the sleeve 34 in a rearward direction away from the hook 24. The U-shaped bite portions 22 are symmetrical about the centerline 15 of the rod end lock 10. Such location of bite portions 22 positions the keeper rod 5 along the centerline 15 of the rod end lock 10. By positioning the keeper rod 5 along the centerline 15, no bending moment is exerted on the rod end lock 10 by an asymmetrical engagement of the keeper rod 5**.

Figure 5:
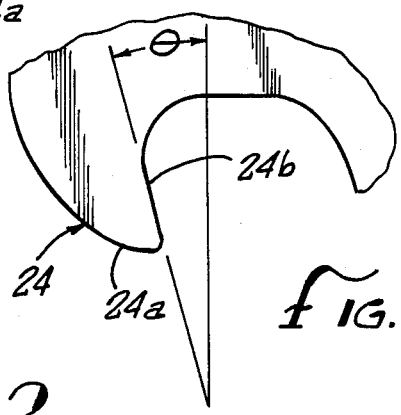
FIG. 5 is a detailed view of the hook portion.

The hook 24 is further illustrated in FIG. 5. The hook 24 has a curved outer surface **24*a* and an inner portion 24*b* which angles inwardly by a degree $\theta$ from the vertical so the hook encloses a keeper rod 5 within the U-shaped bite portion 22**. The preferred value for $\theta$ is about 15°.

Figure 9:
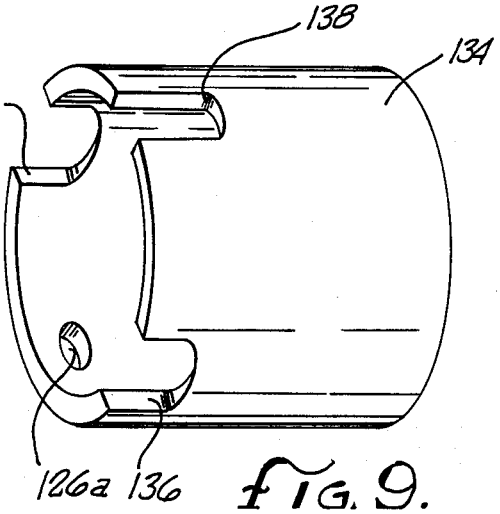
FIG. 9 is a perspective view of the sleeve portion.
Figure 10:
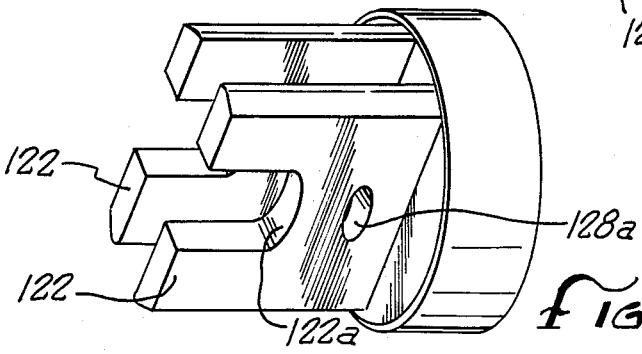
FIG. 10 is a perspective view of the bite portion of the embodiment of FIG. 6 (and is also applicable to the embodiment of FIG. 1)
Figure 11:
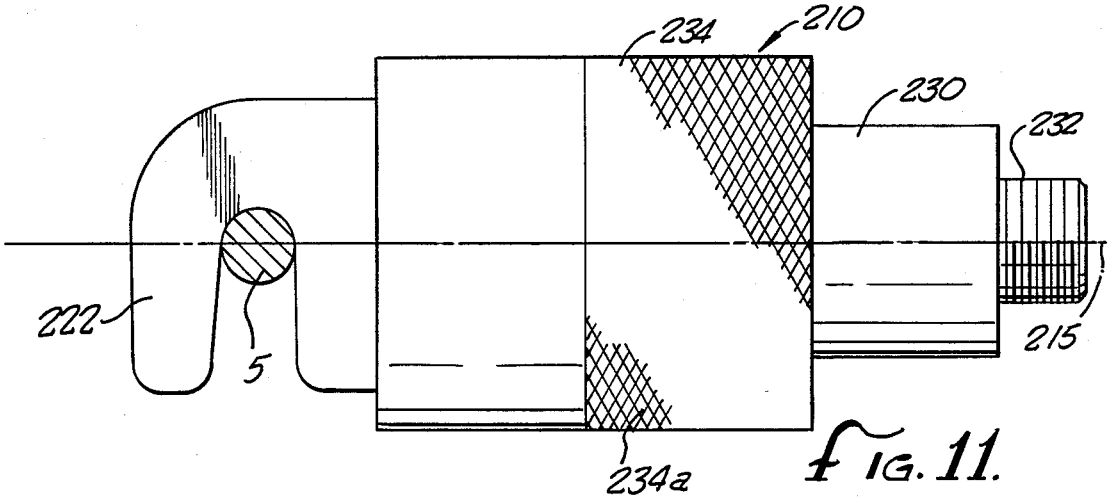
FIG. 11 is a side of view of an alternative embodiment for side entry of a rod, the embodiment illustrating the open position.

FIGS. 6–10 illustrate a similar rod end lock 110 in which a sleeve 134 is actuated or slides in an opposite direction to that of the rod end lock 10 of FIG. 1. The rod end lock 110 has a barrel 130 encircled by a slidably fitted sleeve 134. The sleeve 134 may have a knurled surface (not shown) to permit easy gripping. A spring 146 situated between the sleeve 134 and the barrel 130 urges the sleeve 134 away from the hook 124. Particularly referring to FIG. 10, the rod end lock 110 has a pair of bite portions 122 each having a U-shaped cutout **122*a* in the ends thereof. The U-shaped cutout 122*a* is symmetrical about the centerline 115 of the barrel 130. The U-shaped cutout 122*a* accommodates the insertion of a keeper rod 5. The locking element is the hook 124 which is pivotally secured by the pivot shaft 128 between bite portions 122. The bite portions 122 have a hole 128*a* therein for the pivot shaft 128. Referring to FIG. 9, the sleeve 134 has slots 136 on either side thereof which correspond to the keeper rod 5 since as the sleeve 134 is actuated forward (as in FIG. 6) it reaches the keeper rod 5. The slots 136 also permit easy access to the pivot shaft 128. The sleeve 134 also has a slot 138 which corresponds to the hook 124 since when the sleeve 134 is actuated forward (as in FIG. 6) the hook 124 pivots clockwise and would be encumbered by the sleeve 134. The slot 138 permits the rotation of the hook 124**.

The rod end lock 110 differs from the rod end lock 10 of FIG. 1 primarily by the method of actuation. The hook 124 of the rod end lock 110 has an extended portion 126 which is positioned on the opposite side of the pivot point 128 as compared to the rod end lock 10 of FIG. 1. The extended portion 126 is positioned within a slot **126*a* of the sleeve 134 such that as the spring 146 urges the sleeve 134 rearward, away from the hook 124, the end portion 126 is also urged rearward rotating the hook 124 counterclockwise as viewed in FIGS. 6–7 thereby enclosing the keeper rod 5 between the hook 124 and bite portion 122. The keeper rod 5 may be released by actuating the sleeve 134 in a forward direction, toward the hook 124, compressing the spring 146 and pivoting the hook 124 in a clockwise direction (as in FIG. 6) thereby releasing the keeper rod 5**.

Therefore, the first two embodiments of the present invention illustrate rod end locks which allow a keeper rod 5 to be inserted from a forward direction along the centerline 15 of the rod end lock 10 or along centerline 115 of rod end lock 110. Both the rod end locks 10 and 110 are biased to the closed position. The rod end lock 10 of FIGS. 1–5 is actuated to the open position by moving the sleeve 34 in a rearward direction (toward the mount 32) while the rod end lock 110 of FIGS. 6–10 is actuated to the open position by moving the sleeve 134 in a forward direction (away from the mount 132). Other actuation combinations are also envisioned and may be obtained by modifying these embodiments. For example, the biasing means shown as spring 46 in FIGS. 3 and 4 or the biasing means shown as spring 146 in FIGS. 6 and 7 may be alternately biased to actuate the respective rod end lock to the open position.

Figure 12:
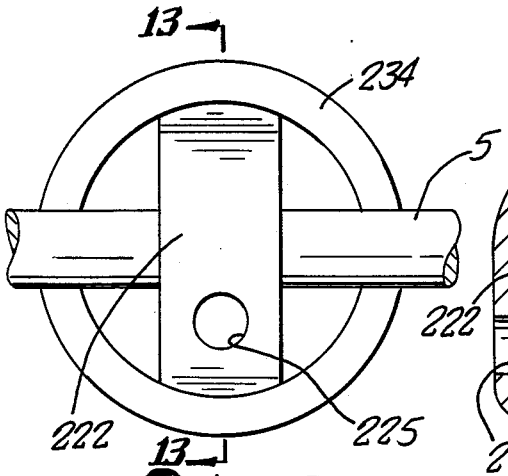
FIG. 12 is a front view of the device of FIG. 11.
Figure 13:
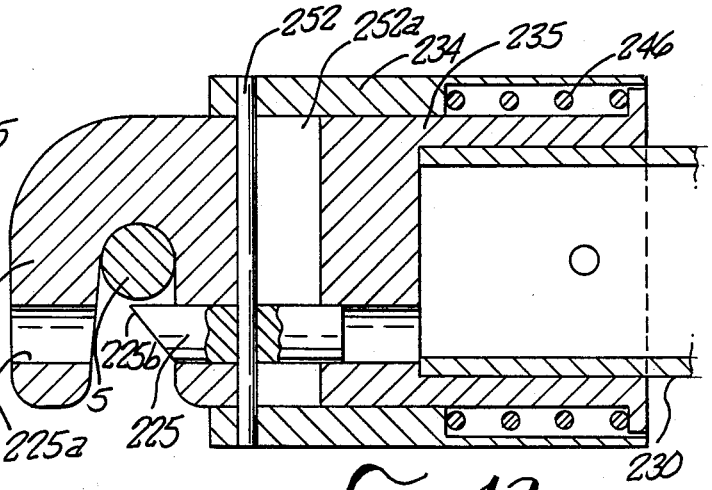
FIG. 13 illustrates a cross-sectional side view of the device of FIG. 12 taken along the line 12—12 illustrating the side entry embodiment in the closed position.
Figure 14:
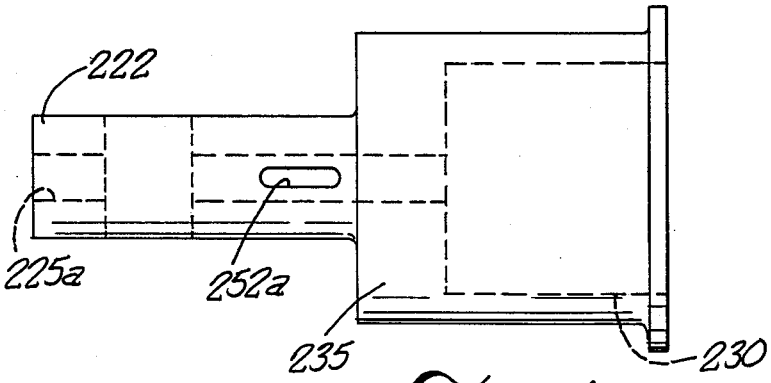
FIG. 14 illustrates a top view of the barrel and bite portions of the side entry embodiment of FIG. 11.

Alternately, it is desirable to have a rod end lock engage from a direction perpendicular to its centerline on a keeper rod. FIGS. 11–14 and FIGS. 15–17 illustrate two such side entry embodiments. FIGS. 11–14 describe a rod end lock 210 having a barrel 230 and a gripping sleeve 234 slidably attached thereabout. The gripping sleeve 234 has a knurled surface **234*a* to allow easy gripping actuation. On one end of the barrel 230 is a threaded mount 232 which is coaxial with the barrel 230 about the centerline 215 and on the opposite end is a bite portion 222 which is formed in a U-shape and perpendicular to the centerline 215 of the rod end lock 210 for accommodating the keeper rod 5. As shown in FIGS. 12–14, the sleeve 234 is slidably positioned concentrically about the barrel 230. The sleeve 234 is urged in a forward direction toward the bite portion 222 by a spring 246. The sleeve 234 engages a locking element comprised of a pin locking mechanism 225 and a connector bar 252. The connector bar 252 is attached to the sleeve 234 and engages a locking pin mechanism 225 such that the sleeve 234, connecting bar 252, and the locking pin 225 all move together. Therefore, as the sleeve 234 is urged forward by the spring 246, the locking pin 225 is also moved forward thereby surrounding the keeper rod 5 within the U-shaped bite portions 222. To release the keeper rod 5, the sleeve 234 may be grasped and pulled rearward (toward the mount 232), compressing the spring 246 and sliding the locking pin 225 rearwardly permitting release of the keeper rod 5. The locking pin 225 has a slanted portion 225*b* which, when pressed against the keeper rod 5 as the keeper rod 5 is attempted to be inserted into the bite portion 222, urges the locking pin 225 rearward thereby compressing the spring 246 and allowing insertion of the keeper rod 5. As the keeper rod 5 passes the tip of the slanted portion 225*b*, the locking pin 225 snaps forward surrounding the keeper rod 5 within the bite portion 222. When locked in place, the keeper rod 5 is secured with its center along the centerline 215**.

FIG. 14 illustrates a top view of the bite portion 222 and the body 235. The barrel 230 may be inserted and attached to the rear end of body 235. FIGS. 13–14 show the bite portion 222 having a longitudinal slot **225*a* in which the locking pin 225 is slidably positioned. The bite portion 222 also has a vertical slot 252*a* through which the connector bar 252 connects the sleeve 234 with the locking pin 225**.

Figure 15:
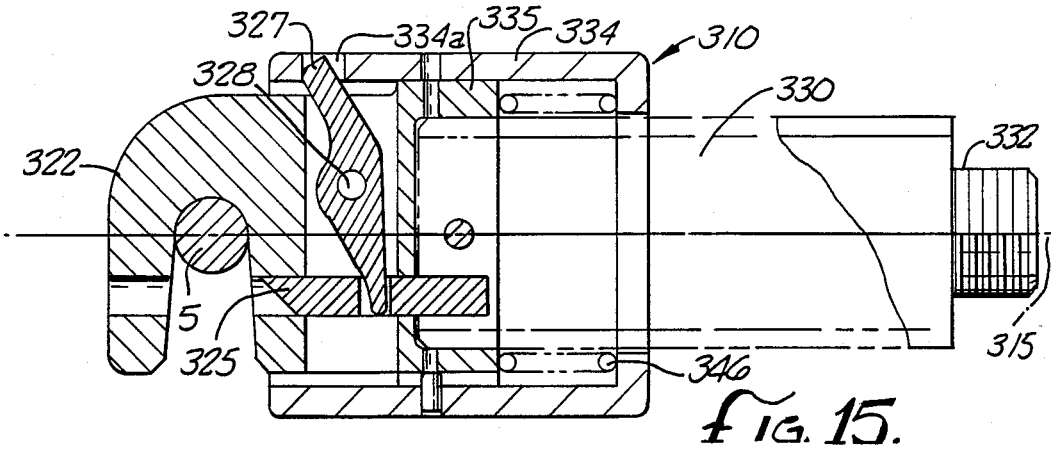
FIG. 15 is an alternative embodiment for side entry of a rod similar to FIGS. 11–14, the embodiment illustrating the open position.
Figure 16:
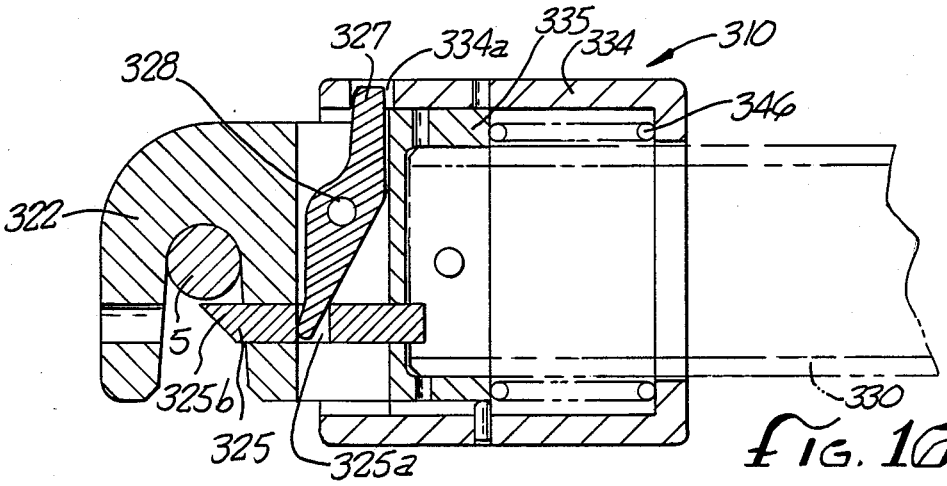
FIG. 16 illustrates the alternative embodiment as in FIG. 15 in the closed position.
Figure 17:
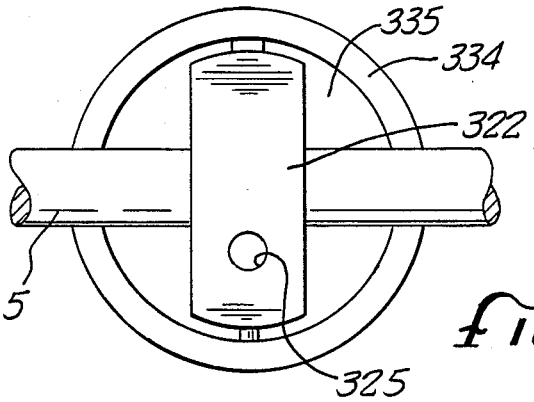
FIG. 17 is a front view of the alternative embodiment as in FIG. 15.

FIGS. 15–17 illustrate an alternative side entry rod end lock 310 in which a collar 334 releases a keeper rod 5 by a forward actuation motion. The rod end lock 310 has a barrel 330 with a threaded mount 332 on one end and a bite portion 322 on the other end. The threaded mount 332 is coaxial with the barrel 330 about the centerline 315. A sleeve 334 is slidably positioned concentrically about the barrel 330 and the body 335. Between the barrel 330 and the sleeve 334 is a spring 346 which urges the sleeve 334 rearward and away from the bite portion 322. The sleeve 334 has a slot **334*a* which engages one end of a lever 327 which pivots about a pivot shaft 328. Pivoting about its pivot point 328, the lever 327 has one end in the slot 334*a* in the sleeve 334 and its opposite end in the slot 325*a* in the locking pin 325. The motion of the sleeve 334 causes the lever 327 to pivot thereby moving the locking pin 325. As shown in FIG. 15, the sleeve 334 has been pushed forward, thereby compressing the spring 346, pivoting the lever 327 counterclockwise, which urges the locking pin 325 rearwardly thereby opening the bite portion 322 for the release (or entry) of the keeper rod 5. FIG. 16 illustrates the rod end lock 310 in the resting position with the spring 346 having urged the collar 334 rearward thereby rotating the lever 327 clockwise thereby urging the locking pin 325 to enclose the keeper rod 5 within the bite portion 322. When locked in place by its locking element as described above, the keeper rod 5 is secured with its center along the centerline 315**. The locking pin 325 has a slanted surface 325*b* (similar to the slanted surface 225*b* of the rod end lock 210 of FIG. 13) which when engaged by the insertion of the keeper rod 5, urges the locking pin 325 rearwardly rotating the lever 327 in a counterclockwise direction thereby urging the sleeve 334 forward this compresses the spring 346 thereby allowing insertion of the keeper rod 5 into the hook 324.

All the embodiments of the present invention have the unique feature of centering the keeper rod 5 along the longitudinal axis or centerline of the respective rod end lock. Advantageously, the mounting position (such as threaded mount 32 in FIG. 1) may also be located along the centerline to avoid a bending moment between the mount and the keeper rod 5. All the bite portions (such as the bite portion 322 in FIG. 15) have substantially a U-shape to contour to the round shape of a rod, but any shape (such as a V-shape or square) which suitably accommodates the rod may be acceptable.

Thus, a rod end lock is disclosed which has superior force balance characteristics. While embodiments and applications of this invention have been shown and described, it would be apparent to those skilled in the art that many more modifications are possible without departing from the inventive concepts herein. The invention, therefore, is not to be restricted except in this spirit of the appended claims.

What is claimed:

1. A rod end lock for latching a keeper, comprising:
a barrel having a mounting end and a latch end;
a mount connection attached to the mounting end of said barrel and coaxial with said barrel;
a bite portion attached to the latch end of said barrel, said bite portion having a substantially U-shape for acccommodating a rod of the keeper such that when inserted into said bite portion, the rod of the keeper is centered about a centerline of said barrel;
a locking element pivotally attached to said barrel and having an open and a closed position, said locking element including a pivot point centered on the centerline of said barrel, and a hook portion pivoting about said pivot point wherein when the locking element is in the closed position, said hook portion and said bite portion form an enclosed space therenbetween for latching the rod of the keeper;
a biasing means for urging said locking element into the closed position; and
a means for actuating said locking element between the opened and closed positions.

2. A rod end lock according to claim 1 wherein said U-shaped bite portion is open away from said mounting end and said U-shaped bite portion has its axis along the centerline of said barrel.

3. A rod end lock for latching a keeper comprising:
a barrel having a mounting end and a latch end;
a mount connection attached to the mounting end of said barrel and coaxial with said barrel;
a bite portion attached to the latch end of said barrel, said bite portion having a shape for accommodating a rod;
a locking element movably connected to said barrel and having an opened and a closed position; and
a means for actuating said locking element between the opened and closed positions,
wherein said locking element comprises a pivot shaft connected to said barrel and a hook portion pivoting about said pivot shaft such that when the locking element is in the closed position, said hook portion and said bite portion form an enclosed space therebetween for latching the rod of the keeper, wherein when the rod inserted into the enclosed space, the rod is centered about the centerline of said barrel, the locking element being constructed and arranged to exert no lateral force on the rod.

4. A rod end lock according to claim 3 further comprising: a biasing means attached to said barrel for urging said locking element to the closed position.

5. A rod end lock according to claim 3 further comprising: a biasing means attached to said barrel for urging said locking element to the open position.

6. A rod end lock for latching a keeper, comprising:
a barrel having a mounting end and a latch end;
a mount connection attached to the mounting end of said barrel and coaxial with said barrel;
a bite portion attached to the latch end of said barrel, said bite portion having a shape for accommodating a rod such that when inserted into said bite portion, the rod is centered about a centerline of said barrel;
a locking element movably connected to said barrel and having an opened and a closed position, wherein when said locking element is in the closed position, said locking element and said bite portion form an enclosed space therebetween for latching the keeper;
a means for actuating said locking element between the opened and closed position, said locking element comprising a pivot shaft connected to said barrel and a hook portion pivoting about said pivot shaft such that when the locking element is in the closed position, said hook portion and said bite portion form the enclosed space therebetween for latching the keeper;
a sleeve portion slidably connected about said barrel;
a spring between said barrel and said sleeve portion urging said sleeve portion away from said mounting end; and
a connecting means between said sleeve and said hook portion such that said hook portion rotates with movement of said sleeve portion.

7. A rod end lock according to claim 3 wherein said bite portion is open away from said mounting end and said bite portion has its axis along the centerline of said barrel.

8. A rod end lock according to claim 6 wherein said hook portion is biased to the closed position and comprises a curved outer surface which when engaged by the keeper rotates said hook portion to the open position allowing insertion of the keeper into the enclosed space.

9. A rod end lock according to claim 3 wherein said bite portion comprises:
two substantially U-shaped bites positioned parallel to each other and having axes along the centerline of said barrel,
wherein said hook portion is positioned between said bites and said pivot shaft is supported between the two bites and passes through the hook portion.

* * * * *